United States Patent [19]

Siiberg

[11] 4,356,365

[45] Oct. 26, 1982

[54] AIR OPERATED DC SWITCH

[75] Inventor: Hemming G. Siiberg, New Providence, N.J.

[73] Assignee: Edison International, Inc., Rolling Meadows, Ill.

[21] Appl. No.: 200,451

[22] Filed: Oct. 24, 1980

[51] Int. Cl.[3] ..... H01H 35/34

[52] U.S. Cl. ..... 200/83 J; 337/329; 200/81 R

[58] Field of Search ..... 335/106, 196; 337/329, 337/375; 340/611, 626; 200/241, 243, 246, 275, 283, 81 R, 81.4, 81.5, 83 J, 83 R, 83 P, 83 A

[56] References Cited

U.S. PATENT DOCUMENTS

| | | | |
|---|---|---|---|
| 3,529,107 | 9/1970 | Dobrikin | 200/83 P |
| 3,617,665 | 11/1971 | Berson | 200/83 P |
| 4,121,073 | 10/1978 | Bileski | 200/83 P |
| 4,204,098 | 5/1980 | Strande | 200/275 |
| 4,297,552 | 10/1981 | Lauritsen | 200/83 P |

*Primary Examiner*—G. P. Tolin

*Attorney, Agent, or Firm*—Ronald J. LaPorte; Jon C. Gealow; Charles W. MacKinnon

[57] ABSTRACT

An air-operated switching device includes first and second spaced supports on which an armature is mounted. The armature includes a resilient blade fixedly mounted at a first end on the first support and for sliding movement with respect to the second support. A resilient contact finger extends from the slidably supported end of the armature and includes a free end having a contact thereon. A fixed contact is positioned in alignment with the contact of the finger. An air-operated actuator applies pressure to the blade causing it to flex with the one end of the blade moving slidably over the second support, thereby causing the finger contact to be moved into engagement with the fixed contact with a wiping motion.

15 Claims, 6 Drawing Figures

AIR OPERATED DC SWITCH

BACKGROUND OF THE INVENTION

The invention relates to an electrical-switching device and, in particular, to an air-operated DC switch. Typically, air-operated switches are used in conjunction with vehicle air brakes to actuate brake lights during air brake applications.

Various types of air-operated switches are known in the prior art. Many of these switches suffer certain draw backs or disadvantages which are overcome by the air-operated switch according to the present invention. One disadvantage of prior art air-operated switches, is that contact build-up which occurs at high levels of current and voltage is caused by deposits of molten contact material during operation of the switch. Such contact build-up reduces the life of these switches.

Another disadvantage of prior art switches of the aforementioned type is that often a member of the switch against which an air-operated plunger is pressed to operate the switch, conventionally is a current carrying member and is thus susceptible to $I^2R$ heating effects and thus early degradation.

Still another disadvantage of prior art air-operated switches of the type described is that the contacts often tend to open and close less rapidly than the air-operated actuating means, causing delays in switch operation.

SUMMARY OF THE INVENTION

Accordingly, it is a primary object of the present invention to provide a new and improved air-operated D.C. switch which overcomes the drawbacks and disadvantages of prior art switches described heretofore.

According to the invention, the switch comprises a novel floating armature and an air-actuated plunger which is operative to move the floating armature to a position where contacts on the armature touch fixed contacts to provide electrical circuit continuity between the fixed contacts.

The floating armature is a flat-leaf blade formed of resilient electrically conductive material having a body portion with three generally parallel fingers projecting therefrom.

At the distal end portion of each of two of the fingers a conventional contact element is affixed by suitable means such as welding or riveting; the distal end portion of the third finger or spring finger terminates in a suitable manner to enable restraint. The armature is held so that the contacts on the fingers are in registration with and spaced from the fixed contacts. The main portion of the armature rests on a ledge above and offset from the fixed contacts.

An air-actuated plunger is disposed on the side of the armature opposite the fixed contacts and positioned adjacent to an intermediate portion of the spring finger so that movement of the plunger toward the fixed contacts will bow the spring finger.

As the middle of the spring finger is depressed by the movement of the plunger, the contact carrying fingers remain straight, projecting substantially as a continuation of the plane of the main portion of the blade so that contacts at distal end portions of these contact carrying fingers are rapidly transported to make contact with the fixed contacts. When the force on the plunger is removed, the spring finger preferably serves as a return spring to return the plunger to its initial position and to swiftly break the contact between the armature contact elements and the fixed contacts.

As the spring finger is depressed, the main body portion of the blade slides along the ledge toward the distal end of the spring finger. The sliding and pivotal motion of the body portion of the blade is reflected in the motion of the contact elements. As the contact elements move into contact with the fixed contacts, a translational motion is imparted to the moving contacts so that they wipe against the fixed contacts. The advantage of this wiping motion is that it inhibits contact buildup.

DESCRIPTION OF THE DRAWINGS

While the armature is discussed in terms of its application to an air-actuated switch, it is clear that the invention is not limited to such a switch and other means of actuation are also contemplated such as, for example a hand-operated or mechanically-actuated plunger.

Other features and attributes of the invention will be seen in the figures in which:

In FIGS. 1*a* and 1*b* an air operated switching device according to the invention is shown generally at 10. A generally circular base plate 12, suitably of phenolic, has molded thereon two terminal posts 14 and 15. On the interior side of the base plate 12, the terminal posts 14 and 15 are staked, respectively to a pair of separate contact plates 16 to which are affixed contacts 18, respectively, in a conventional manner, such as by riveting. Since the contact plates and contacts are identical only one contact plate 16 and contact 18 are shown in the drawings.

Figure 1A:
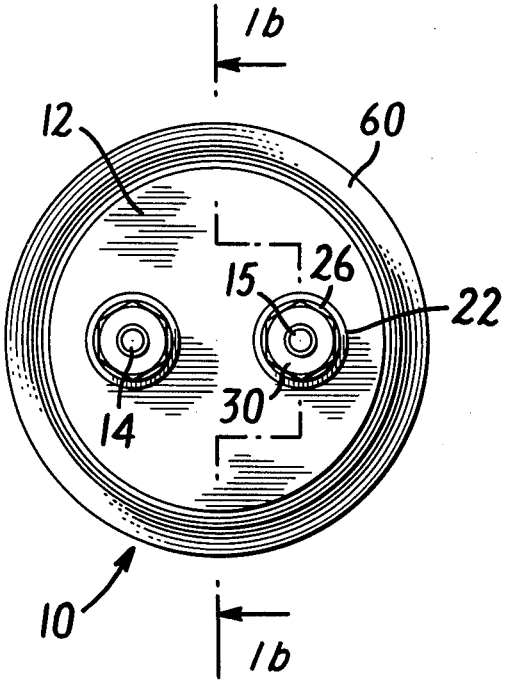
FIG. 1*a* is an end view of an air-operated switch.

To the exterior of the base plate the terminal posts 14 and 15 are threaded so that each may receive washers 22, 24, and 26, and nuts 28 and 30 for the purpose of securing conventional electrical leads (not shown) to the terminal posts. Other conventional terminals such as spade lugs, self-locking connectors or other similar conventional connectors may also be utilized as desired.

An annular flange 32 projecting from the base 12 forms a lip creating a recess 34 in which the contact plates 16 are disposed. A plunger guide 36, suitably of phenolic, is disposed adjacent to the base plate 12. An axial bore 38 through the plunger guide 36 slidingly receives a plunger 40. Plunger 40, also suitably of phenolic, has a cap 42 of larger diameter than the axial bore 38. The cap 42 nests in a recess 44 in the plunger guide 36 on the side opposite the fixed contacts 18.

A pressure cap 45, suitably of metal, is positioned adjacent to the plunger guide 36 so that plunger guide 36 is sandwiched between the pressure cap 45 and the base plate 12. A threaded extension 46 of the pressure cap 45 is adapted for connection in a conventional manner, as, for example, a threaded fitting, to an air pressure conduit (not shown).

A diaphragm 48 covers the plunger cap 42 and extends beyond an annular lip 52 of the pressure cap 45 and is held between lip 52 and an annular lip 53 of the plunger guide 36. Between the annular lip 52 and the lip 53 is disposed a pressure seal such as, for example, O-ring 54.

The interior of the pressure cap 45 is recessed to form a cavity 56 hermetically sealed by diaphragm 48 and pressure seal 54. An orifice 58 passing through extension 46 is operative for connection of pressure to the cavity 56.

A clamping ring 60 is formed around the circumference of the juxtaposed parts to hold them in position.

Figure 2A:
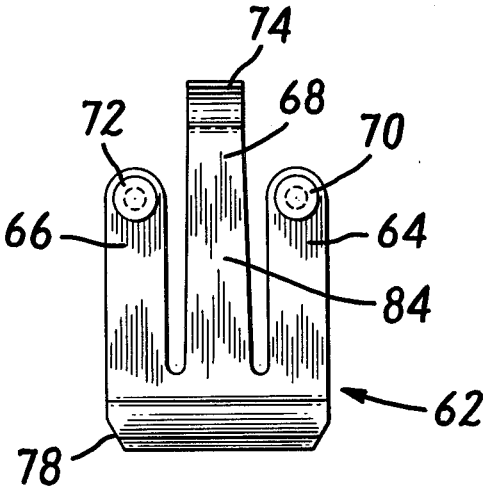
FIG. 2*a* is a top view of the armature of the switch of FIG. 1.
Figure 2B:
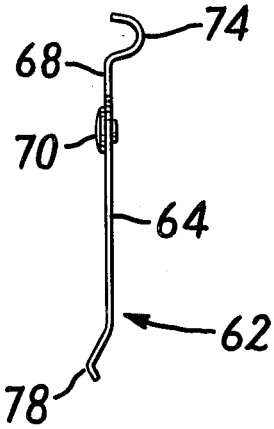
FIG. 2*b* is a side view of the armature of FIG. 2*a*

A resilient, electrically conducting armature 62 is disposed between the base plate 12 and the plunger guide 36. As best seen in FIGS. 2*a* and 2*b*, the armature 62 comprises a leaf type blade having three projecting fingers 64, 66, and 68. Conventional contact elements 70 and 72, preferably of known silver-enriched alloy, are affixed by conventional means, such as riveting, to the distal end portions of the outer fingers 64 and 66. Conveniently, the blade is a continuous piece, however, it is evident that the separate fingers may be suitably attached by conventional fastening means to function in the same manner as the continuous piece. It is evident to one skilled in the art that one or more contact carrying fingers may be utilized.

The distal end portion of finger 68 terminates in a generally U shape hook which fits over a semicylindrical protuberance 80 of base plate 12. The protuberance 80 extends nearly to the plunger guide 36 so that the hook is loosely captured between the protuberance 80 and plunger guide 36 to support the free end portion of finger 68. One advantage of this preferred form of support is that the free end portion of finger 68 tends to act as a hinge when the armature is flexed in operation.

The unitary body portion of the armature is bent to form a check-mark-shaped fold 78. The bottom of the check-mark fold 78 rests in sliding contact on a flat ledge 82 on the interior side of the base plate 12. Movement of the plunger 40 toward finger 68 is operative to apply a force on the intermediate section 84 of finger 68 which thereby will bow. It will be understood that shapes other than check-mark 78 may be used to provide the sliding contact support for the body of the armature and any convenient means may be employed for supporting the free end portion of finger 68.

In operation, as the cavity 56 fills with pressure from the pressure conduit at the initiation of brake application, the force of the air pressure against diaphragm 48 is transmitted to the plunger 40 causing it to move toward finger 68.

Figure 3A:
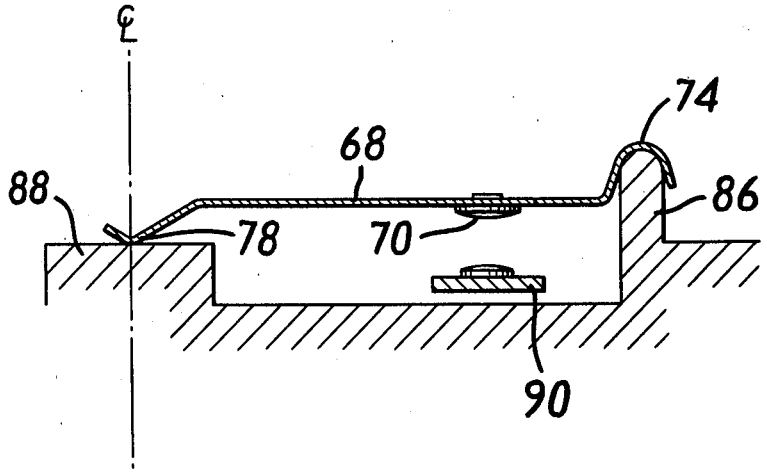
FIGS. 3*a* and *b* are schematic illustrations of the action of the armature when an activating force is applied.
Figure 3B:
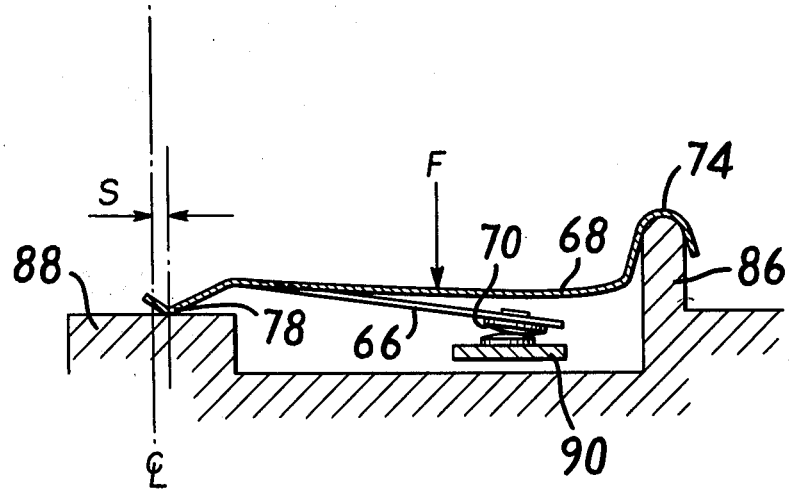

The action of the armature 62 in response to the displacement force of plunger 40 is illustrated schematically in FIGS. 3*a* and 3*b*.

In FIG. 3*a*, hook 74 of finger 68 is held by a representative semi-cylindrical protuberance 86 (80) while the bottom of fold 78 rests on representative ledge 88 (82). Contact 70 is positioned above a representative fixed contact 90 (18). The remaining arm and contacts are not shown.

When force is applied to an intermediate section of finger 68, for example, by means of plunger 40, the finger 68 bows since it is supported at each end by protuberance 86 and ledge 88. As the finger 68 bows, the contact-carrying outer fingers 64 and 66 which are not constrained at their distal end portions, therefore, tend to continue in the plane of the body portion of the blade. The bowing of finger 68 thus causes the ends of contact-carrying finger 64 and 66 to be displaced downward towards the fixed contact 90.

As is illustrated in FIG. 3*b*, when the finger 68 is bowed, the fold 78 slides on support 88 through a distance S so that contact 70 is also displaced horizontally as it is being displaced in the downward direction. The result of the horizontal displacement is a wiping action of contact 70 across the fixed contact 90. It is also evident from FIGS. 3*a* and 3*b* that the separate fingers 66 and 64 result in a faster contact-closing velocity than the rate of the actuation by force F against the intermediate portion 84. For best results of fast contact speed of make and break, the contact carrying fingers 64 and 66 are elongated so that the contacts are supported beyond the center of finger 68 between the supports at opposite ends thereof. It will be appreciated that the longer the contact carrying fingers 64 and 66, the faster the contact speed of make or break.

Turning again to FIG. 2*a*, it is evident that when armature 62 bridges the two fixed contacts, the current path is from one of the contact-carrying fingers 64 of 66 through the body portion of the blade to the opposite contact-carrying finger 66 or 64. Finger 68, the spring finger is bypassed by the current and, therefore, is not heated by $I^2R$ heating losses which can cause deterioration in the spring characteristics of the armature 62.

Figure 1B:
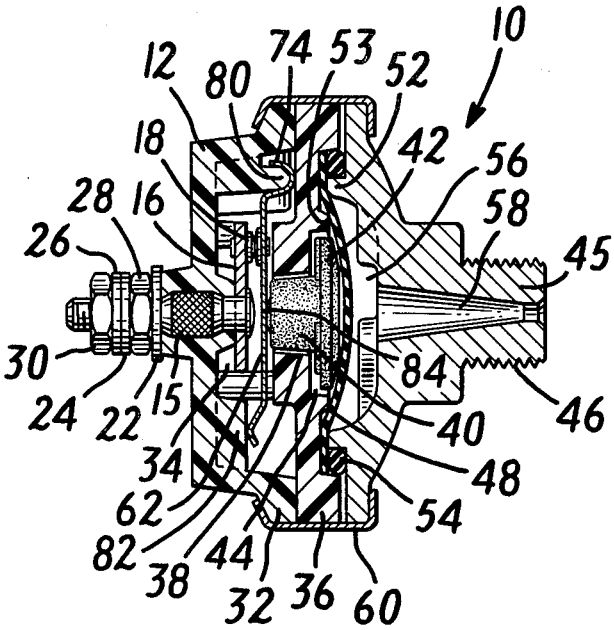
FIG. 1*b* is a side-sectional view of the air-operated switch according to the invention.

As is best seen in FIG. 3*b*, the bowed spring finger 68 produces, due to its springiness, an upward force countering that of the actuating force, so that when the actuating force is removed finger 68 returns to its normal position thereby opening the contact 70 and 90. In FIG. 1*b*, where the force against the intermediate portion 84 is provided by an air-actuated plunger 40, when air pressure is vented from cavity 56, the plunger 40 is moved away back to its original position by the spring return action of finger 68. It is evident that there is a fast break and a reverse wiping action of the contacts in similar manner to that occuring on the making of the contacts.

It is understood that the claims are intended to cover all changes and modifications of the preferred embodiments of the invention, herein chosen for the purpose of illustration which do not constitute departures from the spirit and scope of the invention.

What is claimed is:

1. In a switching device having at least one fixed contact, an armature, and an actuating means for moving said armature, the improvement wherein:

(a) said armature comprises floating blade having a first end including a main portion with at least two fingers extending therefrom, said main portion defining mechanical contact means;

(b) at least one of said fingers having a contact at the distal end portion thereof;

(c) means for supporting said armature so that said contact at the distal end portion of said one finger is in registration with and spaced from said fixed contact;

(d) said armature support means including:

(i) means fixedly positioning the distal end portion of the other of said two fingers of said floating blade of said armature; and (ii) surface means supportively engaging said mechanical contact means of said main portion of said armature, said mechanical contact means being slidable along said surface means in response to the application to force to said armature by said actuating means; and (e) said actuating means being positioned adjacent to an intermediate portion of said other of said at least two fingers for applying a force to said intermediate portion, said armature flexing in response to the application of said force for engaging said contacts in a wiping motion.

2. The switching device of claim 1 wherein there is a second fixed contact and said armature includes a third finger having a contact at the distal end portion thereof in registration with said second fixed contact.

3. The switching device of claim 2 wherein said actuating means is a plunger.

4. The switching device of claim 3 wherein said actuating means further comprises a diaphragm covering said plunger, said diaphragm sealing said plunger from a pressure chamber wherein the force of air pressure in said pressure chamber is transmitted to said plunger.

5. The switching device of claim 1 wherein the fingers and main portion of said blade are of a continuous resilient metal piece.

6. The switching device of claim 5 wherein the continuous resilient metal piece is beryllium copper.

7. The switching device of claim 2 wherein said fingers having contacts at the ends thereof are shorter than the other finger.

8. A switch for controlling a brake light for an air pressure actuated vehicle brake system which comprises;

(a) housing;
(b) a resilient armature in said housing;
(c) first means for slidably supporting a first end portion of said armature;
(d) second means spaced from said first means for fixedly supporting the second opposite end portion of said armature;
(e) a first and a second finger each projecting outwardly from a first end portion of said armature toward the second end portion thereof;
(f) the projecting end portions of said fingers being free to move relative to the second end portion of said armature;
(g) a contact mounted on each of the projecting end portions of said fingers;
(h) a pair of spaced fixed contacts each of which is aligned with and opposes one of said finger contacts, respectively;
(i) air pressure actuated means for applying force to said armature between said first and second support means to cause said armature to bow for engaging and disengaging said finger contacts and the corresponding fixed contacts in a wiping motion.

9. The structure of claim 8 in which said fixed contacts are initially in spaced relationships with said finger contacts and wherein the contacts are closed when said armature is bowed by said force.

10. The structure of claim 8 in which said armature includes a portion bridging the space between said first and second support means and wherein said fingers project out beyond the middle of the bridging portion of said armature between said support means.

11. The structure of claim 8 in which said armature includes a portion bridging the space between said first and second support means and wherein the air pressure actuated means apply force to the middle of the bridging portion of said armature between said support means.

12. The structure of claim 8 in which the said fingers project out on opposite sides of said armature.

13. A switch for controlling a brake light for an air pressure actuated vehicle brake system which comprises;

(a) a housing;
(b) a resilient armature in said housing;
(c) first means for slidably supporting a first end portion of said armature;
(d) second means spaced from said first means for supporting the second opposite end of said armature in fixed position, said armature including a portion bridging the space between said first and second support means;
(e) a first and a second finger each projecting outwardly from a first end portion of said armature on opposite sides thereof toward the second end portion of said armature, beyond the middle of the bridging portion of said armature between said first and second support means;
(f) the projecting portions of said fingers being unsupported and free to move relative to the second end portion of said armature;
(g) a pair of spaced fixed contacts each of which opposes one of the respective fingers;
(h) each of said fingers having a contact thereon aligned with one of said fixed contacts in spaced relationship with respect thereto;
(i) a plunger in said housing positioned to apply a force generally to the middle of the bridging portion of said armature between said first and second support means on the opposite side of said armature from that which the fixed contacts face; and
(j) air pressure actuated means for moving said plunger toward said armature to apply force and bow said armature toward said fixed contacts whereby each of the contacts on said fingers are closed against the respective fixed contacts in a wiping motion when said force is applied and whereby the resilient armature returns said plunger to its initial position when said force is released to open said contacts.

14. A switch for controlling a brake light for an air pressure actuated vehicle brake system which comprises:

(a) a housing;
(b) a resilient armature in said housing;
(c) first means for slidably supporting a first end portion of said armature,
(d) second means spaced from said first means for fixedly supporting the second opposite end portion of said armature;
(e) at least one finger that projects out from the first end portion of said armature toward the second end portion thereof;
(f) the outer end portion of said at least one finger being unsupported and having a first contact thereon;
(g) a second contact in said housing in spaced relationship to said first contact;
(h) air pressure actuated means for applying force against said armature between said first and second spaced support means to flex said armature and thereby cause said contacts to close in a wiping motion.

15. An air-actuated D.C. switch including in combination:

a plunger;
at least one fixed electrical contact;

a resilient armature comprising a flat blade having a main portion and at least two finger portions extending from said main portion, said main portion defining a fold therein, said finger portions being arranged generally parallel to each;

a first one of said finger portions having an electrical contact near the distal end thereof;

means for supporting said armature including means for restraining the distal end of the other of said finger portions, a shoulder having a flat surface parallel to the plane of said armature, said fold of said main portion of said flat blade mounted for sliding engagement with respect to said shoulder, said shoulder and said restraining means positioning said armature with said contact at the distal end of said first finger portion in registration with said fixed contact, said plunger positioned for engagement with said other of said fingers intermediate said distal end and said main portion for moving said contact at the distal end of said first finger portion into contacting engagement with said fixed contact in a wiping motion.

* * * * *